US007912399B2

(12) United States Patent
Moser et al.

(10) Patent No.: US 7,912,399 B2
(45) Date of Patent: Mar. 22, 2011

(54) APPARATUS FOR CHARGING A PHOTOCONDUCTOR AND CLEANING A SCOROTRON GRID

(75) Inventors: Rasin Moser, East Rochester, NY (US); Charles Deichmiller, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 177 days.

(21) Appl. No.: 12/260,572

(22) Filed: Oct. 29, 2008

(65) Prior Publication Data

US 2010/0104315 A1 Apr. 29, 2010

(51) Int. Cl.
*G03G 15/02* (2006.01)

(52) U.S. Cl. ..... 399/100

(58) Field of Classification Search ..... 399/100, 399/101, 171

See application file for complete search history.

(56) References Cited

U.S. PATENT DOCUMENTS 4,841,146 A 6/1989 Gundlach et al.
7,212,771 B2 5/2007 Tanaka et al.
7,272,337 B2 * 9/2007 Owens ..... 399/100
7,412,186 B2 * 8/2008 Sekovski et al. ..... 399/100
2008/0159776 A1 * 7/2008 Tanase ..... 399/100
2008/0199206 A1 * 8/2008 Zona et al. ..... 399/100

* cited by examiner

*Primary Examiner* — Sandra L Brase
(74) *Attorney, Agent, or Firm* — Matthew C. Loppnow; Prass LLP

(57) ABSTRACT

An apparatus (100) useful in printing for charging a photoconductor and for cleaning a scorotron grid is disclosed. The apparatus can include a scorotron frame (110) and a scorotron charge member (120) coupled to the scorotron frame, where the scorotron charge member can be configured to generate an electric field. The apparatus can include a scorotron charging grid (130) coupled to the scorotron frame, the scorotron charging grid having a length axis, a width axis, and a height axis, and the scorotron charging grid including a scorotron charging grid surface having a plurality of openings. The apparatus can include a scorotron charging grid cleaner (140) coupled to the scorotron charging grid, where the scorotron charging grid cleaner can be configured to travel along the scorotron charging grid length axis and clean the scorotron charging grid. The scorotron charging grid cleaner can include a scorotron charging grid cleaner center and scorotron charging grid cleaner ends at opposite ends from the scorotron charging grid cleaner center along the width axis. The scorotron charging grid cleaner can extend further in a direction of the height axis at the scorotron charging grid cleaner center than at the scorotron charging grid cleaner ends.

17 Claims, 6 Drawing Sheets

APPARATUS FOR CHARGING A PHOTOCONDUCTOR AND CLEANING A SCOROTRON GRID

BACKGROUND

Disclosed herein is an apparatus for charging a photoconductor and cleaning a scorotron grid.

Presently, in electrostatographic or xerographic printing, an electrostatic latent image is formed on a charge-retentive imaging surface, such as the surface of a photoconductor, and then developed with an application of toner particles. The toner particles adhere electrostatically to the suitably-charged portions of the photoconductor. The toner particles are then transferred, by the application of electric charge, to media, such as print sheets, to form the desired image on the media. An electric charge can also be used to separate or "detack" the print sheet from the photoreceptor.

For the initial charging, transfer, or detack of an imaging surface, a scorotron can be used to apply a predetermined charge to the imaging surface. A scorotron includes a conductor, which is electrically biased and thereby supplies ions for charging the imaging surface. The conductor typically comprises one or more wires, such as corona wires, and/or a metal bar forming saw-teeth, such as a pin array. The conductor can extend parallel to the imaging surface along a direction perpendicular to a direction of motion of the imaging surface. Other structures, such as a screen grid, a conductive shield and/or a nonconductive housing, are typically present in a scorotron charging device, and some of these may be electrically biased as well.

A scorotron can become contaminated with debris, which results in non-uniform charging of the photoconductor and ultimately results in image quality defects. A flat cleaning brush can be used against the bottom of scorotron grid to periodically remove the debris from the grid. The brush traverses the grid by manual or automated operation. Unfortunately, the flat brush tends to deflect the center of grid, which results in the brush making reduced or no contact in center, where best cleaning is actually required.

Thus, there is a need for an improved apparatus for cleaning a scorotron grid that charges a photoconductor.

SUMMARY

An apparatus for cleaning a scorotron grid that charges a photoconductor is disclosed. The apparatus can include a scorotron frame and a scorotron charge member coupled to the scorotron frame, where the scorotron charge member can be configured to generate an electric field. The apparatus can include a scorotron charging grid coupled to the scorotron frame, the scorotron charging grid having a length axis, a width axis, and a height axis, and the scorotron charging grid including a scorotron charging grid surface having a plurality of openings. The apparatus can include a scorotron charging grid cleaner coupled to the scorotron charging grid, where the scorotron charging grid cleaner can be configured to travel along the scorotron charging grid length axis and clean the scorotron charging grid. The scorotron charging grid cleaner can include a scorotron charging grid cleaner center and scorotron charging grid cleaner ends at opposite ends from the scorotron charging grid cleaner center along the width axis. The scorotron charging grid cleaner can extend further in a direction of the height axis at the scorotron charging grid cleaner center than at the scorotron charging grid cleaner ends.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
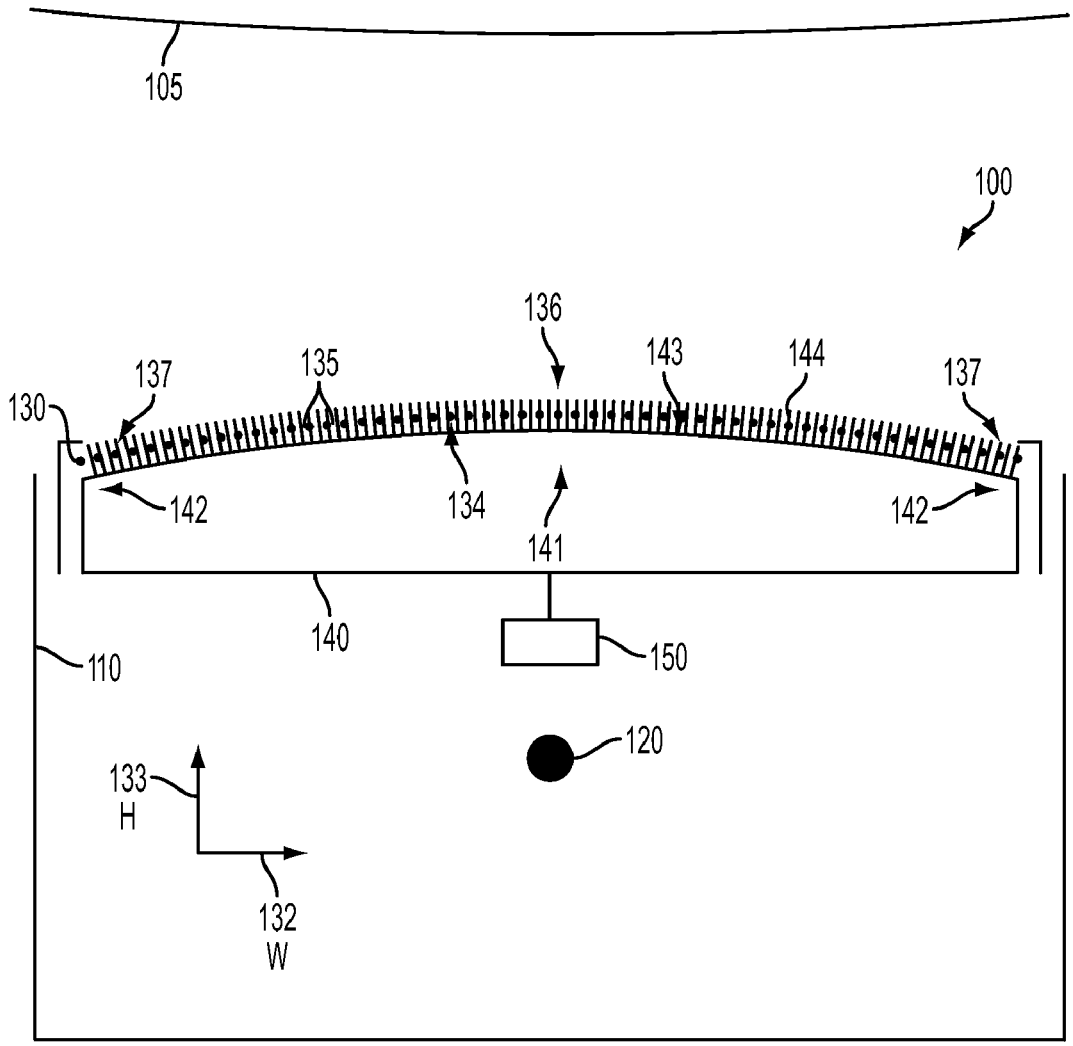
FIG. 1 is an exemplary cut away view of an apparatus useful in printing.

The embodiments include an apparatus useful in charging a photoconductor in printing. The apparatus can include a scorotron frame and a scorotron charge member coupled to the scorotron frame, where the scorotron charge member can be configured to generate an electric field. The apparatus can include a scorotron charging grid coupled to the scorotron frame, the scorotron charging grid having a length axis, a width axis, and a height axis, and the scorotron charging grid including a scorotron charging grid surface having a plurality of openings. The apparatus can include a scorotron charging grid cleaner coupled to the scorotron charging grid, where the scorotron charging grid cleaner can be configured to travel along the scorotron charging grid length axis and clean the scorotron charging grid. The scorotron charging grid cleaner can include a scorotron charging grid cleaner center and scorotron charging grid cleaner ends at opposite ends from the scorotron charging grid cleaner center along the width axis. The scorotron charging grid cleaner can extend further in a direction of the height axis at the scorotron charging grid cleaner center than at the scorotron charging grid cleaner ends.

The embodiments further include a scorotron useful in charging a photoconductor in printing. The scorotron can include a scorotron frame and a scorotron charge member coupled to the scorotron frame, where the scorotron charge member can be configured to generate an electric field. The scorotron can include a scorotron charging grid coupled to the scorotron frame, the scorotron charging grid having a length axis, a width axis, and a height axis, and the scorotron charging grid including a scorotron charging grid surface having a plurality of openings. The scorotron can include a scorotron charging grid cleaner coupled to the scorotron charging grid, the scorotron charging grid cleaner configured to travel along the scorotron charging grid length axis and clean the scorotron charging grid, the scorotron charging grid cleaner including a scorotron grid cleaner surface configured to contact the scorotron charging grid surface, where the scorotron grid cleaner surface can have a convex arched profile.

The embodiments further include an apparatus useful in printing. The apparatus can include a media transport configured to transport media and a photoconductor configured to generate an image on the media. The apparatus can include a scorotron frame and a scorotron charge member coupled to the scorotron frame, where the scorotron charge member can be configured to generate an electric field. The apparatus can include a scorotron charging grid coupled to the scorotron frame, the scorotron charging grid having a length axis, a width axis, and a height axis, the scorotron charging grid including a scorotron charging grid surface having a plurality of openings, and the scorotron charging grid surface being deflectable in a direction of the height axis. The apparatus can include a scorotron charging grid cleaner coupled to the scorotron charging grid, the scorotron charging grid cleaner configured to travel along the scorotron charging grid length axis and clean the scorotron charging grid, the scorotron charging grid cleaner including a scorotron charging grid cleaner center and scorotron charging grid cleaner ends at opposite ends of the scorotron charging grid cleaner center along the width axis, and the scorotron charging grid cleaner extending further in a direction of the height axis at the scorotron charging grid cleaner center than at the scorotron charging grid cleaner ends. The scorotron charging grid and the charge member can be configured to generate a surface potential on the photoconductor.

Figure 2:
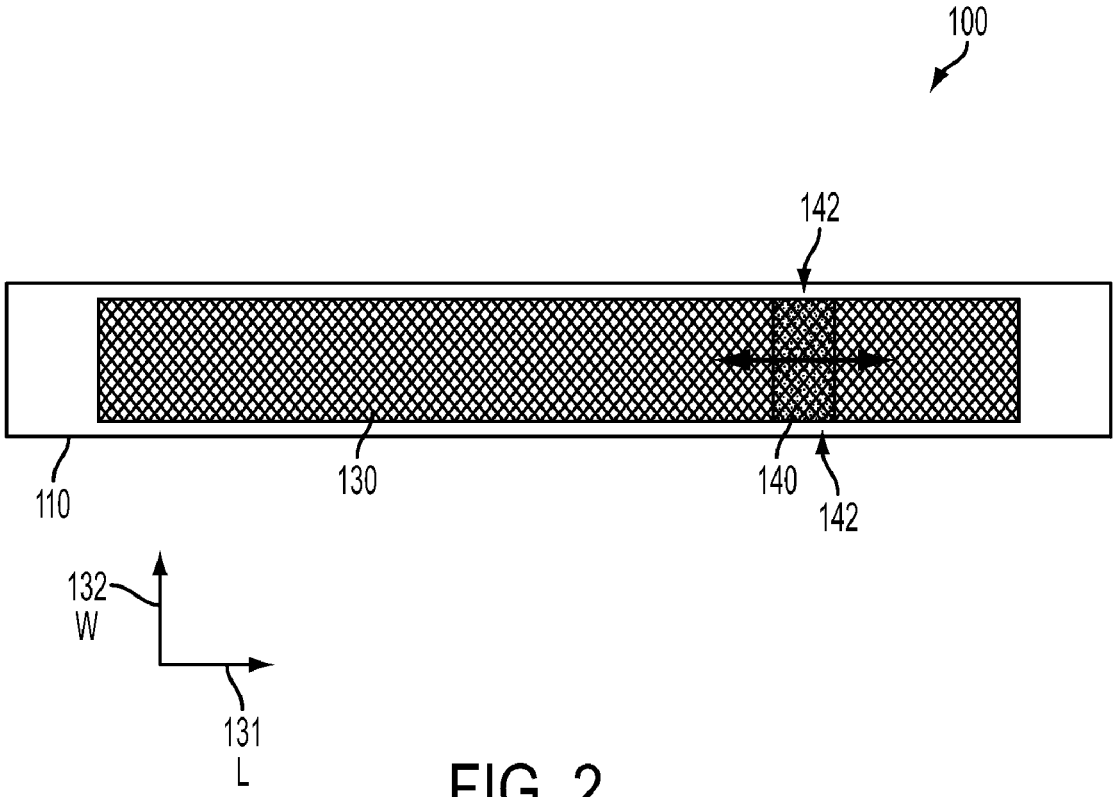
FIG. 2 is an exemplary top view of an apparatus.

FIG. 1 is an exemplary cut away view of an apparatus 100 and FIG. 2 is an exemplary top view of an apparatus 100. The apparatus 100 may be part of a printer, may be a multifunction media device, may be a xerographic machine, or may be any other device that uses a scorotron to charge a photoconductor 105 in printing. The photoconductor 105 can be a conductor, a photoreceptor, or any other device that can create an electrostatic latent image on a surface charged by a scorotron. For example, the photoconductor 105 can be a device that receives light to create an electrostatic latent image on its surface after being charged by a scorotron.

The apparatus 100 can include a scorotron frame 110 and a scorotron charge member 120 coupled to the scorotron frame 110. The scorotron charge member 120 can be configured to generate an electric field. The scorotron charge member 120 can be a charge wire, can be a pin array, or can be any other member useful for generating an electric field or for producing corona to charge a photoconductor 105.

The apparatus 100 can include a scorotron charging grid 130 coupled to the scorotron frame 110. The scorotron charging grid 130 can be located between the scorotron charge member 120 and the photoconductor 105 and the scorotron charging grid 130 and the scorotron charge member 120 can be configured to generate a surface potential on the photoconductor 105. The scorotron charging grid 130 can have a length axis 131, a width axis 132, and a height axis 133. The scorotron charging grid 130 can include a scorotron charging grid surface 134 having a plurality of openings 135. The scorotron charge member 120 can be configured to produce a charge to generate the electric field and the scorotron charging grid 130 can be configured to diffuse the charge from the scorotron charge member 120 through the plurality of openings 135. The scorotron charging grid surface 134 can be deflectable in a direction of the height axis 133.

The apparatus 100 can include a scorotron charging grid cleaner 140 coupled to the scorotron charging grid 130. The scorotron charging grid cleaner 140 can be configured to travel along the scorotron charging grid length axis 131 and clean the scorotron charging grid 130. The scorotron charging grid cleaner 140 can be configured to travel between the scorotron charge member 120 and the scorotron charging grid 130 when cleaning the scorotron charging grid 130. The scorotron charging grid cleaner 140 can include a scorotron charging grid cleaner center 141 and scorotron charging grid cleaner ends 142 at opposite ends of the scorotron charging grid cleaner 140 from the scorotron charging grid cleaner center 141 along the width axis 132. The scorotron charging grid cleaner 140 can extend further in a direction of the height axis 133 at the scorotron charging grid cleaner center 141 than at the scorotron charging grid cleaner ends 142. The scorotron charging grid cleaner 140 can have a scorotron grid cleaner surface 143 configured to contact the scorotron charging grid surface 134 and the scorotron grid cleaner surface 143 can have an arched profile. The scorotron charging grid cleaner 140 can have a cleaning member, such as a brush 144, abutting the scorotron charging grid 130 and a moving mechanism 150 configured to move the scorotron charging grid cleaner 140 along the scorotron charging grid length axis 131. The scorotron charging grid cleaner surface 143 can have or can be a scorotron charging grid cleaning brush 144.

The scorotron charging grid 130 can include a scorotron charging grid center 136 and scorotron charging grid ends 137 at opposite sides of the scorotron charging grid center 136 along the width axis 132 and the scorotron charging grid 130 can deflect more in a direction of the height axis 133 at the scorotron charging grid center 136 than at the scorotron charging grid ends 137 when the scorotron charging grid cleaner 140 cleans the scorotron charging grid 130. The scorotron charging grid cleaner 140 can extend further in the height axis 133 at the scorotron charging grid cleaner center 141 than at the scorotron charging grid cleaner ends 142 to substantially correspond to deflection of the scorotron charging grid 130 when the scorotron charging grid cleaner 140 cleans the scorotron charging grid 130.

According to a related embodiment, the apparatus 100 can be a scorotron 100 useful in charging a photoconductor 105 in printing. The scorotron 100 can include a scorotron frame 110. The scorotron 100 can include a scorotron charge member 120 coupled to the scorotron frame 110, where the scorotron charge member 120 can be configured to generate an electric field. The scorotron 100 can include a scorotron charging grid 130 coupled to the scorotron frame 110. The scorotron charging grid 130 can have a length axis 131, a width axis 132, and a height axis 133. The scorotron charging grid 130 can include a scorotron charging grid surface 134 having a plurality of openings 135. The scorotron charging grid surface 134 can be deflectable in a direction of the height axis 133. The scorotron 100 can include a scorotron charging grid cleaner 140 coupled to the scorotron charging grid 130. The scorotron charging grid cleaner 140 can be configured to travel along the scorotron charging grid length axis 131 and can be configured to clean the scorotron charging grid 130. The scorotron charging grid cleaner 140 can include a scorotron grid cleaner surface 143 configured to contact the scorotron charging grid surface 134. The scorotron grid cleaner surface 143 can have a convex arched profile. The scorotron grid cleaner surface 143 can be either a scorotron charging grid cleaning brush 144 or a mount for the scorotron charging grid cleaning brush 144. For example, the brush 144 can have longer or more bristles in the center 141 of the scorotron grid cleaner or the brush 144 can have substantially consistent length bristles on the scorotron grid cleaner surface 143 and a mount for the scorotron charging grid cleaning brush 144 can have a convex arched profile.

The scorotron charging grid cleaner surface 143 can include a scorotron charging grid cleaner center 141 and scorotron charging grid cleaner ends 142 at opposite ends from the scorotron charging grid cleaner center 141 along the width axis 132. The scorotron charging grid cleaner 141 can extend further in a direction of the height axis 133 at the scorotron charging grid cleaner center 141 than at the scorotron charging grid cleaner ends 142. The scorotron charging grid cleaner 140 can extend further in the height axis 133 at the scorotron charging grid cleaner center 141 than at the scorotron charging grid cleaner ends 142 to substantially correspond to deflection of the scorotron charging grid 130 when the scorotron charging grid cleaner 140 cleans the scorotron charging grid 130.

Figure 3:
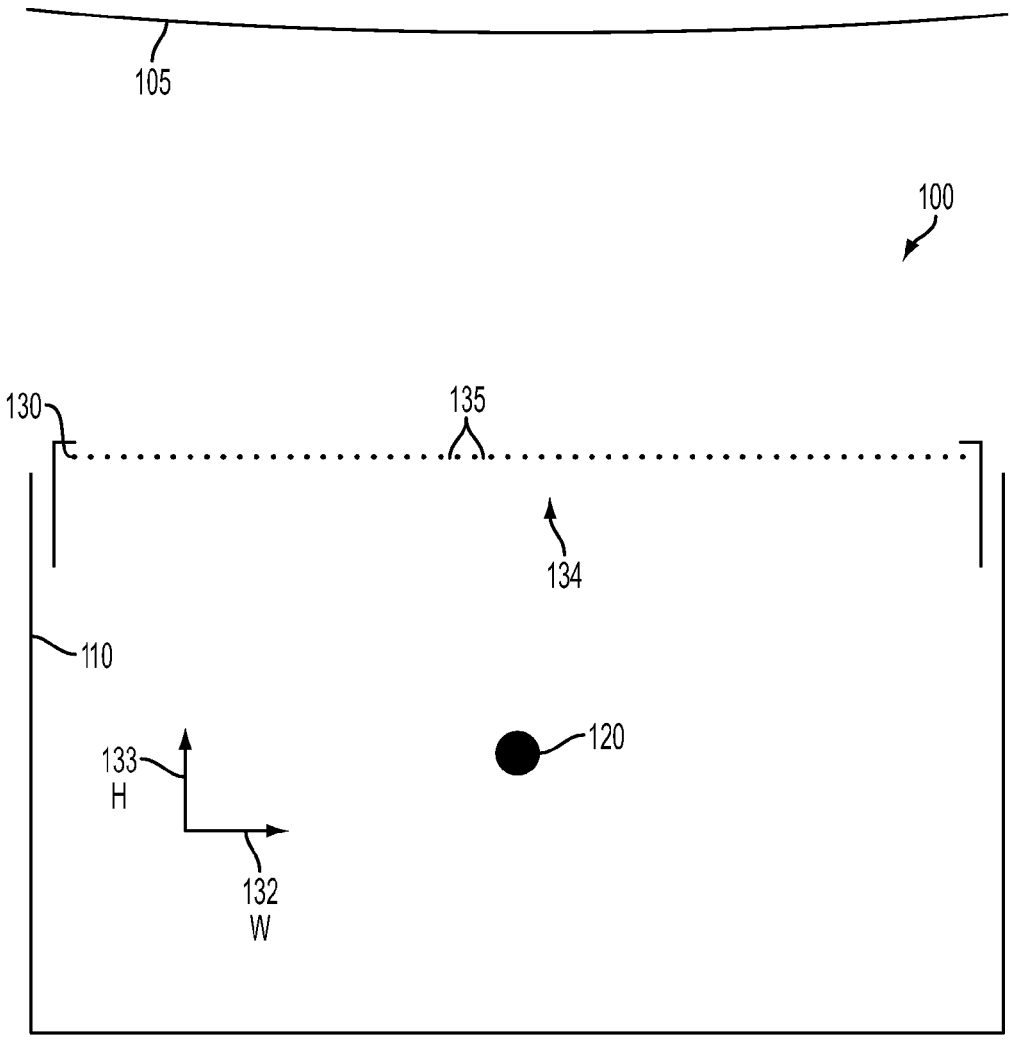
FIG. 3 is an exemplary illustration of an apparatus.

FIG. 3 is an exemplary illustration of an apparatus 100 when not cleaning the scorotron charging grid 130. As shown, when the scorotron charging grid cleaner 140 is not cleaning the scorotron charging grid 130, the scorotron charging grid surface 134 may not necessarily deflect in a direction of the height axis 133 and may stay substantially planar.

Figure 4:
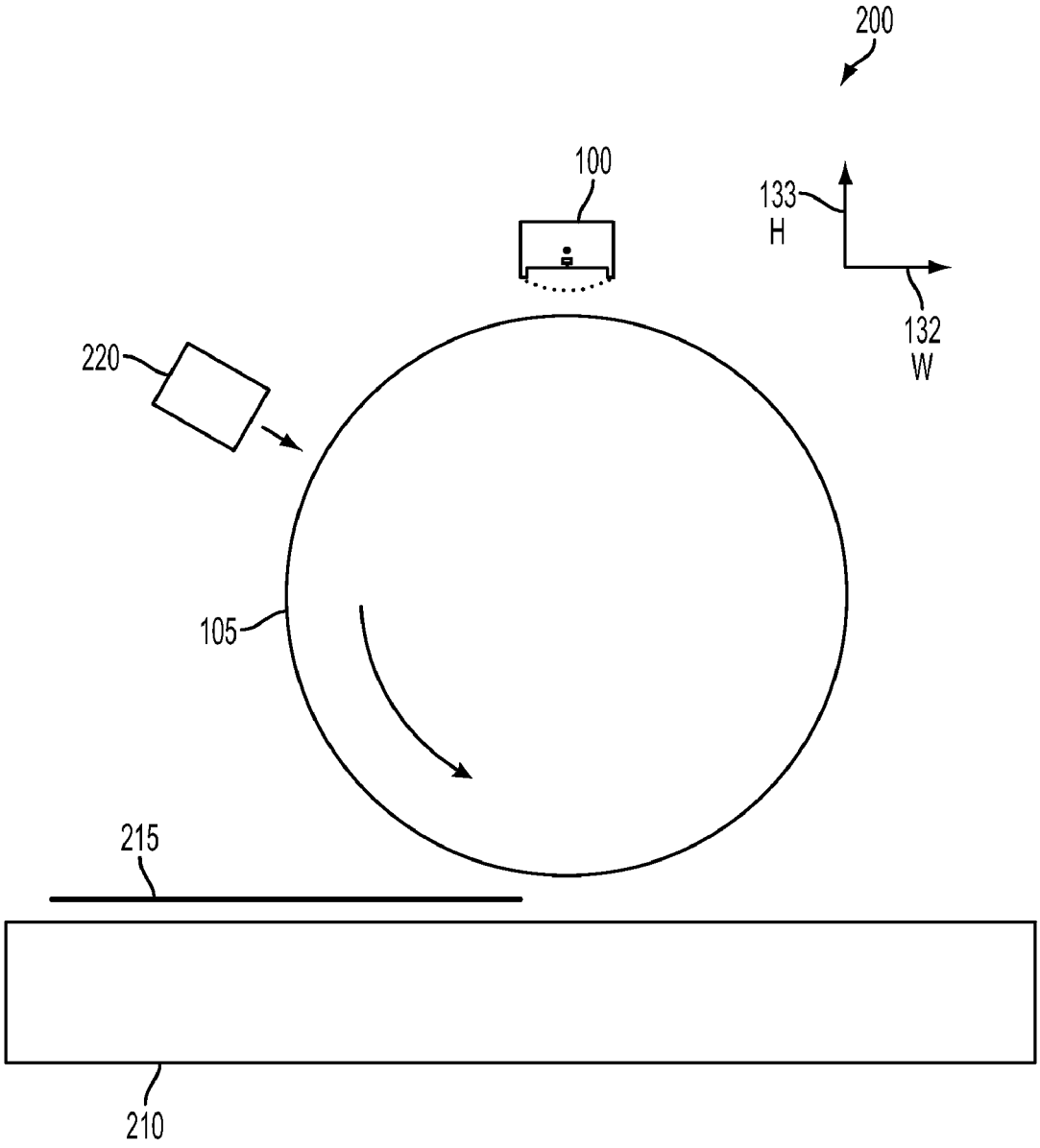
FIG. 4 is an exemplary illustration of an apparatus.

FIG. 4 is an exemplary illustration of an apparatus 200 useful in printing according to another embodiment. The apparatus 200 can include a media transport 210 configured to transport media 215. The apparatus 200 can include a photoconductor 105 configured to generate an image on the media 215. The apparatus 200 can include the scorotron 100 from the previous embodiments and can include an image generation module 220. The scorotron 100 can charge the photoconductor 105 and the image generation module 220 can generate an image on the charged photoconductor 105. The photoconductor 105 can then transfer the image to the media 215.

As shown in previous embodiments, the scorotron can include a scorotron frame 110. The scorotron 100 can include a scorotron charge member 120 coupled to the scorotron frame 110. The scorotron charge member 120 can be configured to generate an electric field. The scorotron 100 can include a scorotron charging grid 130 coupled to the scorotron frame 110. The scorotron charging grid 130 can have a length axis 131, a width axis 132, and a height axis 133. The scorotron charging grid 130 can include a scorotron charging grid surface 134 having a plurality of openings 135. The scorotron charging grid surface 134 can be deflectable in a direction of the height axis 133. The scorotron 100 can include a scorotron charging grid cleaner 140 coupled to the scorotron charging grid 130. The scorotron charging grid cleaner 140 can be configured to travel along the scorotron charging grid length axis 131 and clean the scorotron charging grid 130. The scorotron charging grid cleaner 140 can include a scorotron charging grid cleaner center 141 and scorotron charging grid cleaner ends 142 at opposite ends from the scorotron charging grid cleaner center 141 along the width axis 132. The scorotron charging grid cleaner 140 can extend further in a direction of the height axis 133 at the scorotron charging grid cleaner center 141 than at the scorotron charging grid cleaner ends 142. The scorotron charging grid cleaner 140 can extend further in a direction of the height axis 133 at the scorotron charging grid cleaner center 141 than at the scorotron charging grid cleaner ends 142 to substantially correspond to deflection of the scorotron charging grid 130 when the scorotron charging grid cleaner 140 cleans the scorotron charging grid 130. The scorotron charging grid cleaner 140 can include a cleaning member 144 abutting the scorotron charging grid 130 and a moving mechanism 150 configured to move the scorotron charging grid cleaner 140 along the scorotron charging grid length axis 131. The scorotron charging grid 130 and the scorotron charge member 120 can be configured to generate a surface potential on the photoconductor 105.

Figure 5:
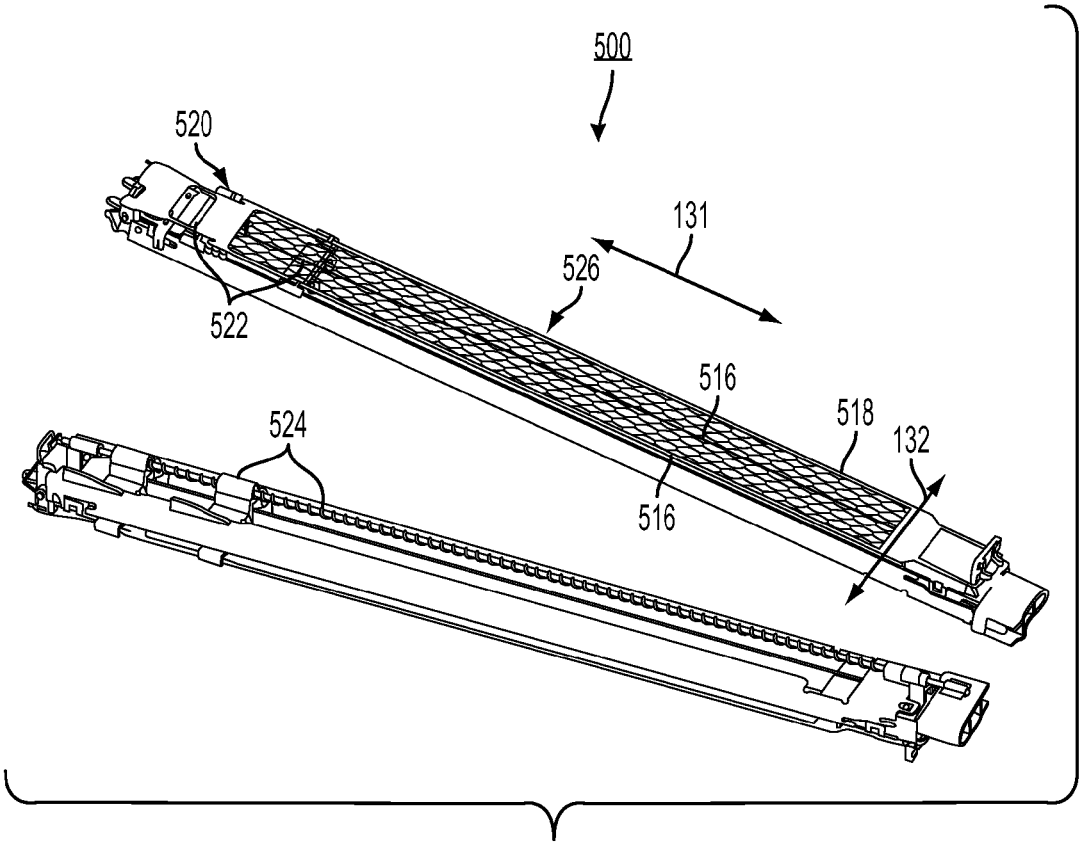
FIG. 5 is an exemplary exploded view of a scorotron.

FIG. 5 is an exemplary exploded view of a scorotron 500. The scorotron 500 can be provided along a direction of a rotational axis of a photoconductor 105 shown in the other embodiments. The scorotron 500 can include a scorotron charge member, such as two corotron wires 516, a grid electrode 518, such as a scorotron charging grid, and a cleaning mechanism 520, such as a scorotron charging grid cleaner. The grid electrode 518 can be disposed so as to be positioned between the corotron wires 516 and a photoconductor. The cleaning mechanism 520 can move in a direction orthogonal to the moving direction of a photoconductor, and can clean the grid electrode 518. For example, an electrode short side direction, such as along the width axis 132, of the scorotron 500 can be a direction orthogonal to the corotron wires 516 and can be oriented the same as the moving direction, such as the rotating direction, of a photoconductor.

The cleaning mechanism 520 can have a brush 522 and can have a moving mechanism 524. The brush 522 can press-contact the grid electrode 518 from the side at which the corotron wires 516 are disposed. The moving mechanism 524 can slide the brush 522 along a rotational axis direction of a photoconductor, such as along the length axis 131, in a state in which the brush 522 press-contacts the grid electrode 518. The cleaning mechanism 520 can clean the grid electrode 518 due to the brush 522 sliding along the length axis 131. The grid electrode 518 can be shaped so as to be long in the length axis 131 direction of the scorotron 100. An opening pattern 526 can be formed in the grid electrode 518 so that the grid electrode 518 is mesh-like.

Figure 6:
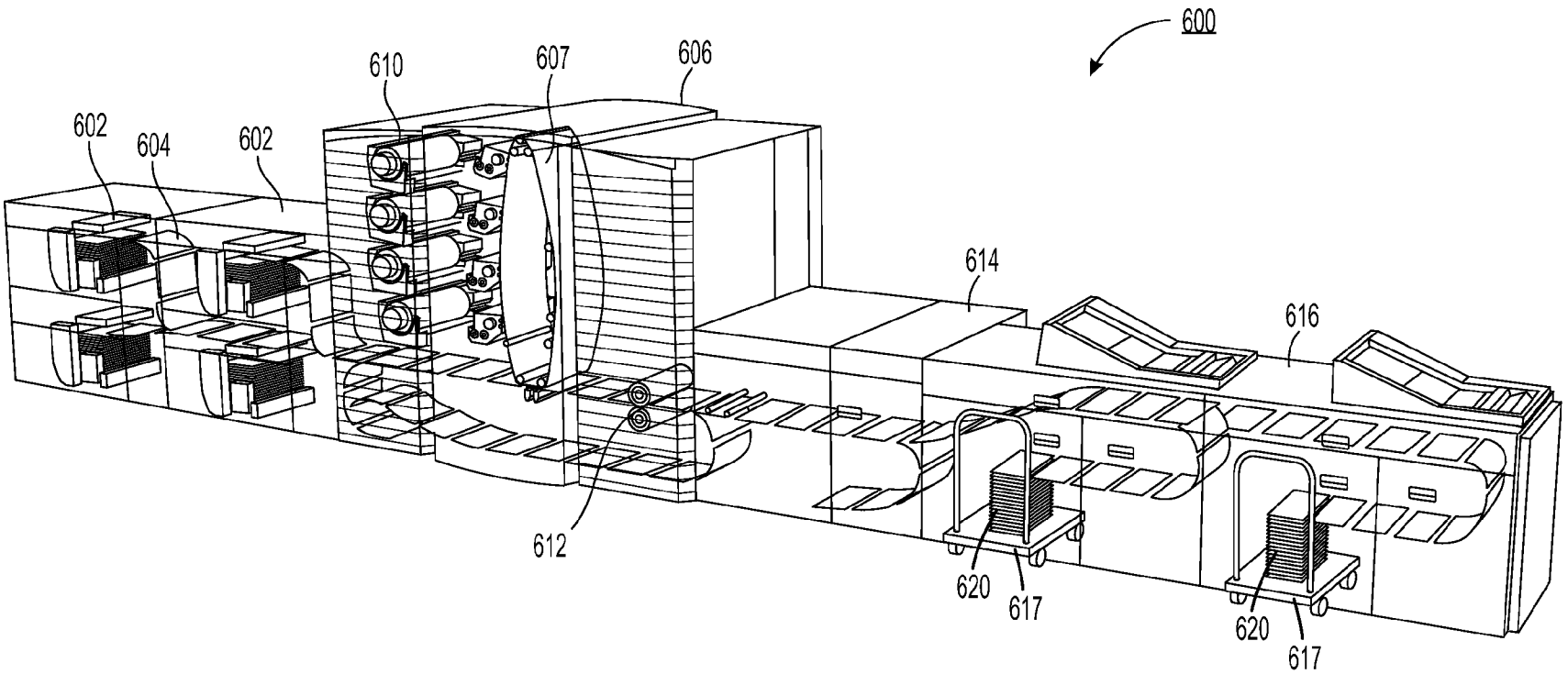
FIG. 6 is an exemplary illustration of a printing apparatus.

FIG. 6 illustrates an exemplary printing apparatus 600 that can include the apparatus 100. As used herein, the term "printing apparatus" encompasses any apparatus, such as a digital copier, bookmaking machine, multifunction machine, and other printing devices that perform a print outputting function for any purpose. The printing apparatus 600 can be used to produce prints from various media, such as coated, uncoated, previously marked, or plain paper sheets. The media can have various sizes and weights. In some embodiments, the printing apparatus 600 can have a modular construction. As shown, the printing apparatus 600 can include at least one media feeder module 602, a printer module 606 adjacent the media feeder module 602, an inverter module 614 adjacent the printer module 606, and at least one stacker module 616 adjacent the inverter module 614.

In the printing apparatus 600, the media feeder module 602 can be adapted to feed media 604 having various sizes, widths, lengths, and weights to the printer module 606. In the printer module 606, the scorotron 100 can charge a photoreceptor belt 607. Toner can be transferred from an arrangement of developer stations 610 to the charged photoreceptor belt 607 to form toner images on the photoreceptor belt 607. The toner images can be transferred to the media 604 fed through a paper path. The media 604 can be advanced through a fuser 612 adapted to fuse the toner images on the media 604. The inverter module 614 can manipulate the media 604 exiting the printer module 606 by either passing the media 604 through to the stacker module 616, or by inverting and returning the media 604 to the printer module 606. In the stacker module 616, printed media can be loaded onto stacker carts 617 to form stacks 620.

Embodiment can provide an arched or crowned shaped support mount for a cleaning brush in a grid cleaner assembly. Mounting the brush on the arched shaped support mount can compensate for grid deflection due to the pressure and load exerted on the underside of the grid during the cleaning process. For example, grid deflection can occur when the brush presses against the otherwise unsupported grid during cleaning operations. Embodiments can improve cleaning reliability and cleaning uniformity across the grid and in the center of the grid, can provide for more effective and consistent cleaning, and can reduce charging non-uniformity.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus useful in charging a photoconductor in printing, the apparatus comprising:

a scorotron frame;

a scorotron charge member coupled to the scorotron frame, the scorotron charge member configured to generate an electric field;

a scorotron charging grid coupled to the scorotron frame, the scorotron charging grid having a length axis, a width axis, and a height axis, and the scorotron charging grid including a scorotron charging grid surface having a plurality of openings; and a scorotron charging grid cleaner coupled to the scorotron charging grid, the scorotron charging grid cleaner configured to travel along the scorotron charging grid length axis and clean the scorotron charging grid, the scorotron charging grid cleaner including a scorotron charging grid cleaner center and scorotron charging grid cleaner ends at opposite ends from the scorotron charging grid cleaner center along the width axis, and the scorotron charging grid cleaner extending further in a direction of the height axis at the scorotron charging grid cleaner center than at the scorotron charging grid cleaner ends, wherein the scorotron charging grid surface is deflectable in a direction of the height axis, and wherein the scorotron charging grid includes a scorotron charging grid center and scorotron charging grid ends at opposite sides of the scorotron charging grid center along the width axis and the scorotron charging grid deflects more in a direction of the height axis at the scorotron charging grid center than at the scorotron charging grid ends when the scorotron charging grid cleaner cleans the scorotron charging grid.

2. The apparatus according to claim 1, wherein the scorotron charging grid cleaner extends further in the height axis at the scorotron charging grid cleaner center than at the scorotron charging grid cleaner ends to substantially correspond to deflection of the scorotron charging grid when the scorotron charging grid cleaner cleans the scorotron charging grid.

3. The apparatus according to claim 1, wherein the scorotron charging grid cleaner comprises a scorotron grid cleaner surface configured to contact the scorotron charging grid surface, the scorotron grid cleaner surface having an arched profile.

4. The apparatus according to claim 3, wherein the scorotron charging grid cleaner surface comprises a scorotron charging grid cleaning brush.

5. The apparatus according to claim 1, wherein the scorotron charging grid cleaner comprises a cleaning member abutting the scorotron charging grid and a moving mechanism configured to move the scorotron charging grid cleaner along the scorotron charging grid length axis.

6. The apparatus according to claim 1, wherein the scorotron charging grid cleaner is configured to travel between the scorotron charge member and the scorotron charging grid when cleaning the scorotron charging grid.

7. The apparatus according to claim 1, wherein the scorotron charge member is configured to produce a charge to generate the electric field, and wherein the scorotron charging grid is configured to diffuse the charge from the scorotron charge member through the plurality of openings.

8. The apparatus according to claim 1, wherein the scorotron charge member comprises a scorotron pin array configured to produce corona.

9. The apparatus according to claim 1, wherein the scorotron charge member comprises a scorotron charge wire configured to produce corona.

10. The apparatus according to claim 1, further comprising a photoconductor, wherein the scorotron charging grid is located between the scorotron charge member and the photoconductor, and wherein the scorotron charging grid and the scorotron charge member are configured to generate a surface potential on the photoconductor.

11. A scorotron useful in charging a photoconductor in printing, the scorotron comprising:

a scorotron frame;

a scorotron charge member coupled to the scorotron frame, the scorotron charge member configured to generate an electric field;

a scorotron charging grid coupled to the scorotron frame, the scorotron charging grid having a length axis, a width axis, and a height axis, and the scorotron charging grid including a scorotron charging grid surface having a plurality of openings; and a scorotron charging grid cleaner coupled to the scorotron charging grid, the scorotron charging grid cleaner configured to travel along the scorotron charging grid length axis and clean the scorotron charging grid, the scorotron charging grid cleaner including a scorotron grid cleaner surface configured to contact the scorotron charging grid surface, and the scorotron grid cleaner surface having a convex arched profile.

12. The scorotron according to claim 11, wherein the scorotron charging grid surface is deflectable in a direction of the height axis.

13. The scorotron according to claim 12, wherein the scorotron charging grid cleaner surface includes a scorotron charging grid cleaner center and scorotron charging grid cleaner ends at opposite ends from the scorotron charging grid cleaner center along the width axis, the scorotron charging grid cleaner extending further in a direction of the height axis at the scorotron charging grid cleaner center than at the scorotron charging grid cleaner ends.

14. The scorotron according to claim 13, wherein the scorotron charging grid cleaner extends further in the height axis at the scorotron charging grid cleaner center than at the scorotron charging grid cleaner ends to substantially correspond to deflection of the scorotron charging grid when the scorotron charging grid cleaner cleans the scorotron charging grid.

15. The scorotron according to claim 11, wherein the scorotron charging grid cleaner surface comprises a scorotron charging grid cleaning brush.

16. An apparatus useful in printing, the apparatus comprising:

a media transport configured to transport media;

a photoconductor configured to generate an image on the media;

a scorotron frame;

a scorotron charge member coupled to the scorotron frame, the scorotron charge member configured to generate an electric field;

a scorotron charging grid coupled to the scorotron frame, the scorotron charging grid having a length axis, a width axis, and a height axis, the scorotron charging grid including a scorotron charging grid surface having a plurality of openings, and the scorotron charging grid surface being deflectable in a direction of the height axis; and a scorotron charging grid cleaner coupled to the scorotron charging grid, the scorotron charging grid cleaner configured to travel along the scorotron charging grid length axis and clean the scorotron charging grid, the scorotron charging grid cleaner including a scorotron charging grid cleaner center and scorotron charging grid cleaner ends at opposite ends from the scorotron charging grid cleaner center along the width axis, and the scorotron charging grid cleaner extending further in a direction of the height axis at the scorotron charging grid cleaner center than at the scorotron charging grid cleaner ends, wherein the scorotron charging grid and the scorotron charge member are configured to generate a surface potential on the photoconductor, and wherein the scorotron charging grid cleaner extends further in a direction of the height axis at the scorotron charging grid cleaner center than at the scorotron charging grid cleaner ends to substantially correspond to deflection of the scorotron charging grid when the scorotron charging grid cleaner cleans the scorotron charging grid.

17. The apparatus according to claim 16, wherein the scorotron charging grid cleaner comprises a cleaning member abutting the scorotron charging grid and a moving mechanism configured to move the scorotron charging grid cleaner along the scorotron charging grid length axis.

* * * * *